US011796182B2

(12) United States Patent
Cowan et al.

(10) Patent No.: US 11,796,182 B2
(45) Date of Patent: Oct. 24, 2023

(54) SECONDARY VENTING ARRANGEMENT FOR GAS OVEN COOKING APPLIANCE

(71) Applicant: Midea Group Co., Ltd., Foshan (CN)

(72) Inventors: Richard W. Cowan, Louisville, KY (US); Felix Conde Zelocuatecatl, Louisville, KY (US); Vern A. Neal, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 210 days.

(21) Appl. No.: 17/356,723

(22) Filed: Jun. 24, 2021

(65) Prior Publication Data

US 2022/0412570 A1 Dec. 29, 2022

(51) Int. Cl.

| | |
|---|---|
| ***F24C 15/00*** | (2006.01) |
| ***F24C 3/00*** | (2006.01) |
| ***F24C 15/20*** | (2006.01) |
| ***F24C 3/12*** | (2006.01) |
| ***F24C 3/08*** | (2006.01) |

(52) U.S. Cl.

CPC ..... *F24C 15/002* (2013.01); *F24C 3/004* (2013.01); *F24C 3/082* (2013.01); *F24C 3/122* (2013.01); *F24C 15/2007* (2013.01); *F24C 15/2021* (2013.01)

(58) Field of Classification Search

CPC .. F24C 15/001; F24C 15/002; F24C 15/2007; F24C 3/004; F24C 3/082; F24C 3/122

USPC ..... 126/273 R

See application file for complete search history.

(56) References Cited

U.S. PATENT DOCUMENTS

| | | | | |
|---|---|---|---|---|
| 3,624,742 | A | 11/1971 | Hurko | |
| 3,624,743 | A | 11/1971 | Dills | |
| 3,739,766 | A | 6/1973 | Helgeson | |
| 5,667,375 | A | 9/1997 | Sebastiani | |
| 5,921,229 | A | 7/1999 | Blake | |
| 8,839,779 | B2 | 9/2014 | Wiker et al. | |
| 9,080,774 | B2 | 7/2015 | Kim et al. | |
| 9,562,694 | B2 | 2/2017 | Paller et al. | |
| 2005/0170302 | A1* | 8/2005 | Ayastuy | F23N 1/00 431/75 |
| 2013/0255660 | A1* | 10/2013 | Han | F24C 3/087 126/273 R |
| 2015/0192307 | A1* | 7/2015 | Paller | F24C 15/322 126/273 R |

FOREIGN PATENT DOCUMENTS

EP 2184545 A1 5/2010

OTHER PUBLICATIONS

Appliance411, Understanding Gas Oven Ignition Systems, Retrieved from: www.appliance411.com/faq/gas_range_ignition_systems.shtml, Retrieved on Jan. 26, 2021.

* cited by examiner

*Primary Examiner* — Vivek K Shirsat
(74) *Attorney, Agent, or Firm* — Gray Ice Higdon

(57) ABSTRACT

A cooking appliance includes a secondary venting arrangement within an oven cavity to supplement a primary venting arrangement with localized venting of combustion products adjacent a flame detector that detects a flame emitted by a gas burner disposed under the oven cavity. Doing so may assist with stabilizing the flame generated by the gas burner prior to establishment of steady state flow pattern within the oven cavity.

20 Claims, 9 Drawing Sheets

SECONDARY VENTING ARRANGEMENT FOR GAS OVEN COOKING APPLIANCE

BACKGROUND

Cooking appliances that include ovens, e.g., ranges, wall-mounted ovens, and the like, generally incorporate multiple cooking elements disposed at different locations in an oven cavity. One or more bake cooking elements are generally positioned on the bottom or underneath the bottom of the oven cavity, while one or more broiler cooking elements are generally positioned near the top of the oven cavity (for the purpose of simplification, this description will use the term "cooking element" to refer to any of the various heat sources that may be utilized to generate the heat required for cooking, which may include, but are not limited to, resistive electrical heating elements, gas burners, infrared heaters, quartz heaters, etc.) Some cooking appliances may also include multiple ovens, each having multiple cooking burners within, and as such, some cooking appliances may include a multitude of cooking elements disposed therein.

In a cooking appliance that relies on gas burners as oven cooking elements, the appliance is generally designed to incorporate a path for drawing in fresh air for combustion and for venting the products of that combustion. A natural flow generally develops over time, in part due to the injection of gas and sometimes additional primary air to the internal volume of the appliance, which displaces the air within the volume. Upon startup and during the warm-up phase of the appliance this gas movement is less controlled, slower, and may even run counter to the flow that is established after the warmup period. As the appliance gets warm, buoyant forces come into play, whereby a pressure gradient is established and the hot air and products of combustion rise. An exhaust vent is generally disposed near the top of the volume such that the hot air and combustion products flow out of the exhaust vent. This ultimately produces a stable, steady state flow pattern through the entire cooking appliance, whereby fresh air is drawn to the gas burner and a hot mix of excess air and combustion products flow up and out through the exhaust vent.

It has been found, however, that while the flow is being established during the warmup phase, combustion is less than optimal, as are the quality and stability of the flames established at the gas burner. This is partially due to an inefficient influx of fresh air available to the flames and an inefficient evacuation of combustion products from the burner box surrounding the gas burner. When a flame sense rod or other flame detector is used to detect the presence of a flame, the signal it receives during this warmup period may also be affected due to poor contact with a less than optimal flame or flames.

Therefore, a need continues to exist in the art for a manner of improving combustion of a gas oven burner, particularly during a warmup phase prior to establishment of a steady state flow pattern.

SUMMARY

The herein-described embodiments address these and other problems associated with the art by providing a cooking appliance including a secondary venting arrangement within an oven cavity to supplement a primary venting arrangement with localized venting of combustion products adjacent a flame detector that detects a flame emitted by a gas burner disposed under the oven cavity. Doing so may assist with stabilizing the flame generated by the gas burner prior to establishment of steady state flow pattern within the oven cavity.

Therefore, consistent with one aspect of the invention, a cooking appliance may include a housing including an oven cavity, an exhaust vent disposed proximate a top of the oven cavity, a gas burner disposed under the oven cavity, a flame detector disposed adjacent to the gas burner and configured to detect a flame emitted by the gas burner, a primary venting arrangement disposed in a lower portion of the oven cavity, the primary venting arrangement configured to vent combustion products generated by the gas burner into the oven cavity and out the exhaust vent as a result of a steady state flow pattern established in the oven cavity after the oven cavity has been warmed by heat generated by the gas burner, and a secondary venting arrangement disposed in the lower portion of the oven cavity and adjacent to the flame detector, the secondary venting arrangement configured to stabilize the flame detected by the flame detector prior to establishment of the steady state flow pattern in the oven cavity through localized venting of combustion products generated by the gas burner into the oven cavity adjacent the flame detector.

Some embodiments may further include one or more fresh air inlets disposed underneath the oven cavity and configured to supply fresh air to the gas burner, and a flow divider disposed underneath the oven cavity and configured to separate the fresh air supplied by the one or more fresh air inlets from the combustion products vented through the primary venting arrangement, and the secondary venting arrangement may provide a shorter flow path around the flow divider than a flow path provided by the primary venting arrangement to reduce combustion product buildup in a volume adjacent the flame detector. Also, in some embodiments, the gas burner extends from a first end proximate a rear of the oven cavity towards a second end proximate a front of the oven cavity, and the flame detector is disposed proximate the first end of the gas burner.

In some embodiments, the gas burner is in fluid communication with a gas supply proximate the first end of the gas burner. In addition, in some embodiments, the one or more fresh air inlets includes first and second air inlets disposed underneath the oven cavity and respectively proximate first and second sides of the oven cavity, the primary venting arrangement includes first and second primary vents formed in a bottom panel of the oven cavity and respectively disposed proximate the first and second sides of the oven cavity, the flow divider extends along first and second sides of the gas burner, fresh air flows inwardly towards the gas burner from the first and second air inlets on an underside of the flow divider, at least a portion of the combustion products generated by the gas burner when the steady state flow pattern is established flow outwardly from the gas burner to the first and second primary vents on the topside of the flow divider, and the secondary venting arrangement is positioned relative to the gas burner and the flame detector such that at least a portion of the combustion products generated by the gas burner flow from the gas burner to the secondary venting arrangement without flowing over the topside of the flow divider.

Also, in some embodiments, the secondary venting arrangement includes one or more vents positioned rearwardly of a rear edge of the flow divider. In addition, some embodiments may further include a flame spreader positioned above the gas burner and extending towards the first and second sides of the oven cavity, and the secondary venting arrangement includes one or more vents positioned rearwardly of a rear edge of the flame spreader. Further, in some embodiments, the secondary venting arrangement includes one or more vents formed proximate a bottom of the oven cavity. Also, in some embodiments, the oven cavity includes a bottom panel, and the one or more vents are formed in the bottom panel. Further, in some embodiments, the bottom panel is removable from the oven cavity.

In some embodiments, the oven cavity includes a bottom panel supported on a flange circumscribing a bottom of the oven cavity, and the one or more vents are formed in part by one or more reliefs in the flange. Also, in some embodiments, the oven cavity includes a removable bottom panel supported by a fixed cavity portion, and the one or more vents are formed in the fixed cavity portion. In some embodiments, the one or more vents includes first and second vents respectively disposed proximate first and second sides of the gas burner. Further, in some embodiments, the one or more vents includes a first vent disposed directly above the flame detector. In some embodiments, the flame detector includes a flame sense rod.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
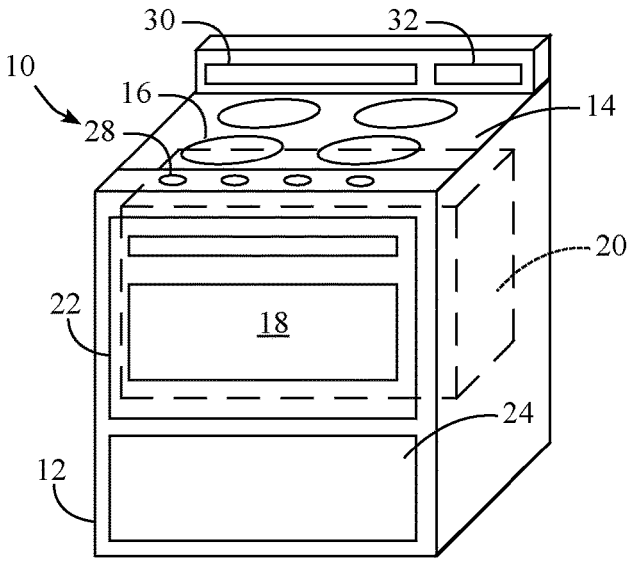
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas cooking elements.

Cooking appliance 10 may also include various user interface devices, including, for example, control knobs 28 for controlling burners 16, a control panel 30 for controlling oven 18 and/or burners 16, and a display 32 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 32 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app.

Display 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a wall mount or freestanding oven. In general, a cooking appliance consistent with the invention may be considered to include any residential-type appliance including a housing and one or more cooking elements disposed therein and configured to generate energy for cooking food within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave cooking elements in some embodiments, while in the case of a stovetop, one or more cooking elements therein may be gas, electric, or inductive cooking elements in some embodiments. Further, it will be appreciated that any number of cooking elements may be provided in a cooking appliance (including multiple cooking elements for performing different types of cooking cycles such as baking or broiling, including multiple bake and/or multiple broiler cooking elements, as well as one or more convection cooking elements), and that multiple types of cooking elements may be combined in some embodiments, e.g., combinations of microwave and light cooking elements in some oven embodiments.

Figure 2:
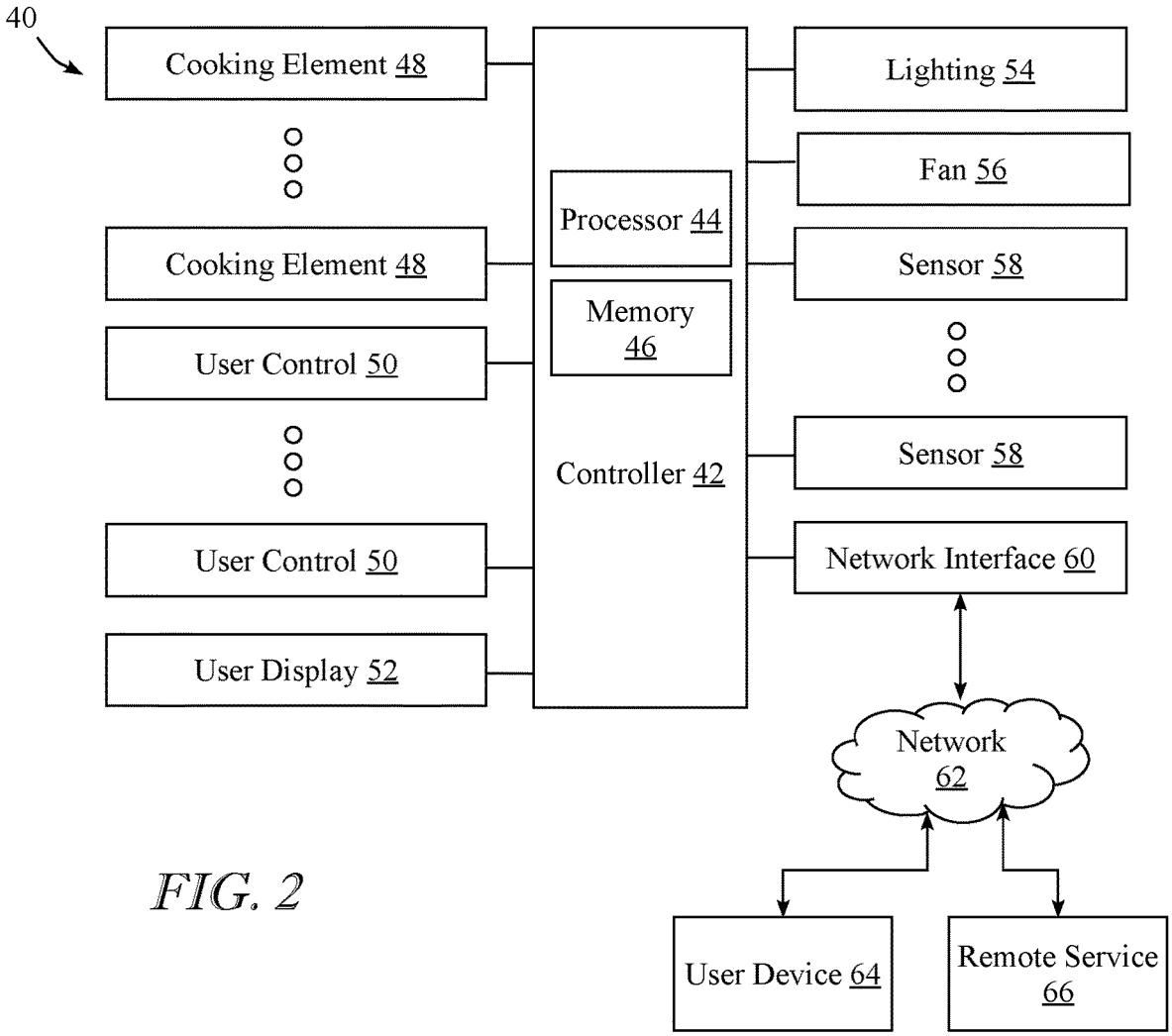
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others. For cooking elements 48 implemented as gas burners, controller 42 may be interfaced with one or more gas valves for regulating gas flow to the gas burners, as well as one or more ignitors for igniting gas supplied to the gas burners; however, these components are not illustrated separately in FIG. 2.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity, including, for example, a temperature sensor for sensing temperature in a center of the oven cavity and/or one or more temperature sensors for sensing temperature in the top and/or bottom of the oven cavity, as well as one or more flame detectors, e.g., flame sense rods or other suitable types of flame detectors capable of sensing a flame emitted by a gas burner.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback. Further, in some embodiments, cooking appliance 40 may be interfaced with one or more remote services 66, e.g., cloud-based services, remote servers.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Secondary Venting Arrangement for Gas Oven Burner

Figure 3:
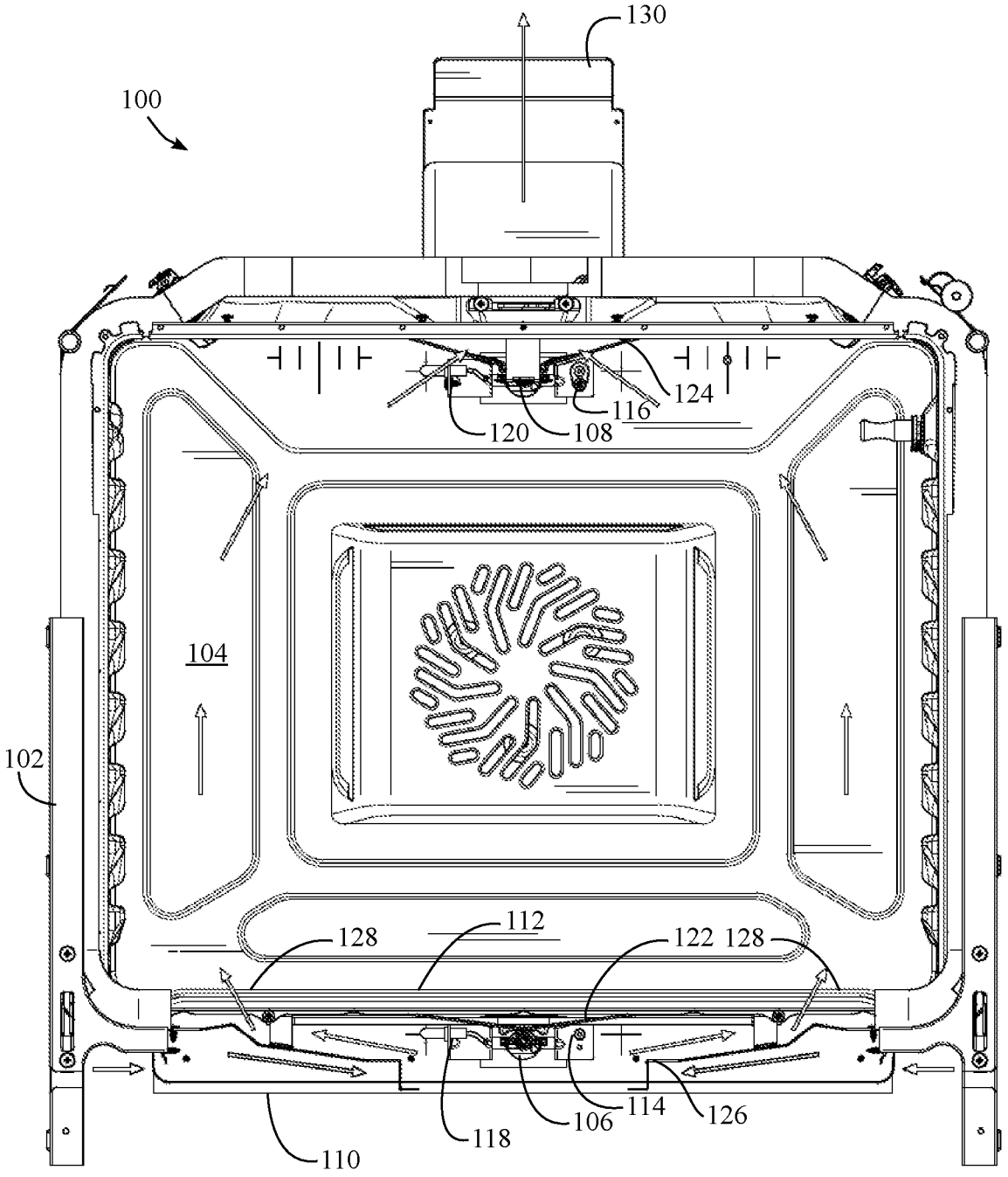
FIG. 3 is a front elevational view of an example cooking appliance oven cavity, and including arrows representing a steady state flow pattern established in the oven cavity.

As noted above, in a cooking appliance that relies on gas burners as oven cooking elements, the appliance is generally designed to incorporate a path for drawing in fresh air for combustion and for venting the products of that combustion. FIG. 3, for example, illustrates an example cooking appliance 100 including a structure 102 defining an oven cavity 104. Bake and broil gas oven burners 106, 108 are disposed proximate the bottom and top of the oven cavity 104, respectively. In some embodiments, broil gas oven burner 108 is disposed within the oven cavity 104, e.g., under the top wall thereof, while bake gas oven burner 106 is disposed under the oven cavity 104, e.g., within a burner box 110 that is separated from the oven cavity 104 by an oven bottom 112, which may be removable in some embodiments.

Each gas oven burner 106, 108 includes an associated flame detector 114, 116, igniter 118, 120, and flame spreader 122, 124. In addition, burner box 110 may also include one or more flow dividers 126 (which may also be considered to include a flow divider formed up multiple pieces) to separate the flow of incoming air to bake gas oven burner 106 from the flow of combustion products and excess air away from bake gas oven burner 106. A primary venting arrangement, e.g., one or more vents, 128, may be provided in oven bottom 112 to vent the combustion products and excess air into oven cavity 104.

It will be appreciated that, when bake gas oven burner 106 is ignited and emitting a flame, a natural flow generally develops over time, in part due to the injection of gas and sometimes additional primary air to the internal volume of the appliance, which displaces the air within the volume. As the appliance gets warm, buoyant forces come into play, whereby a thermal gradient is established and the hot air and products of combustion rise. An exhaust vent 130 is generally disposed near the top of the volume such that the hot air and combustion products flow out of the exhaust vent. This ultimately produces a stable, steady state flow pattern, represented by the arrows in FIG. 3, whereby fresh air is drawn into burner box 110, generally from the sides and underneath flow divider 126 and to bake oven gas burner 106. The fresh air is combusted with gas supplied to bake oven gas burner 106, and a hot mix of excess air and combustion products flow from bake oven gas burner 106, generally within the volume between flow divider 126 and oven bottom 112, out through vents 128 and into oven cavity 104. The flow then continues upwards and out through exhaust vent 130.

Figure 4:
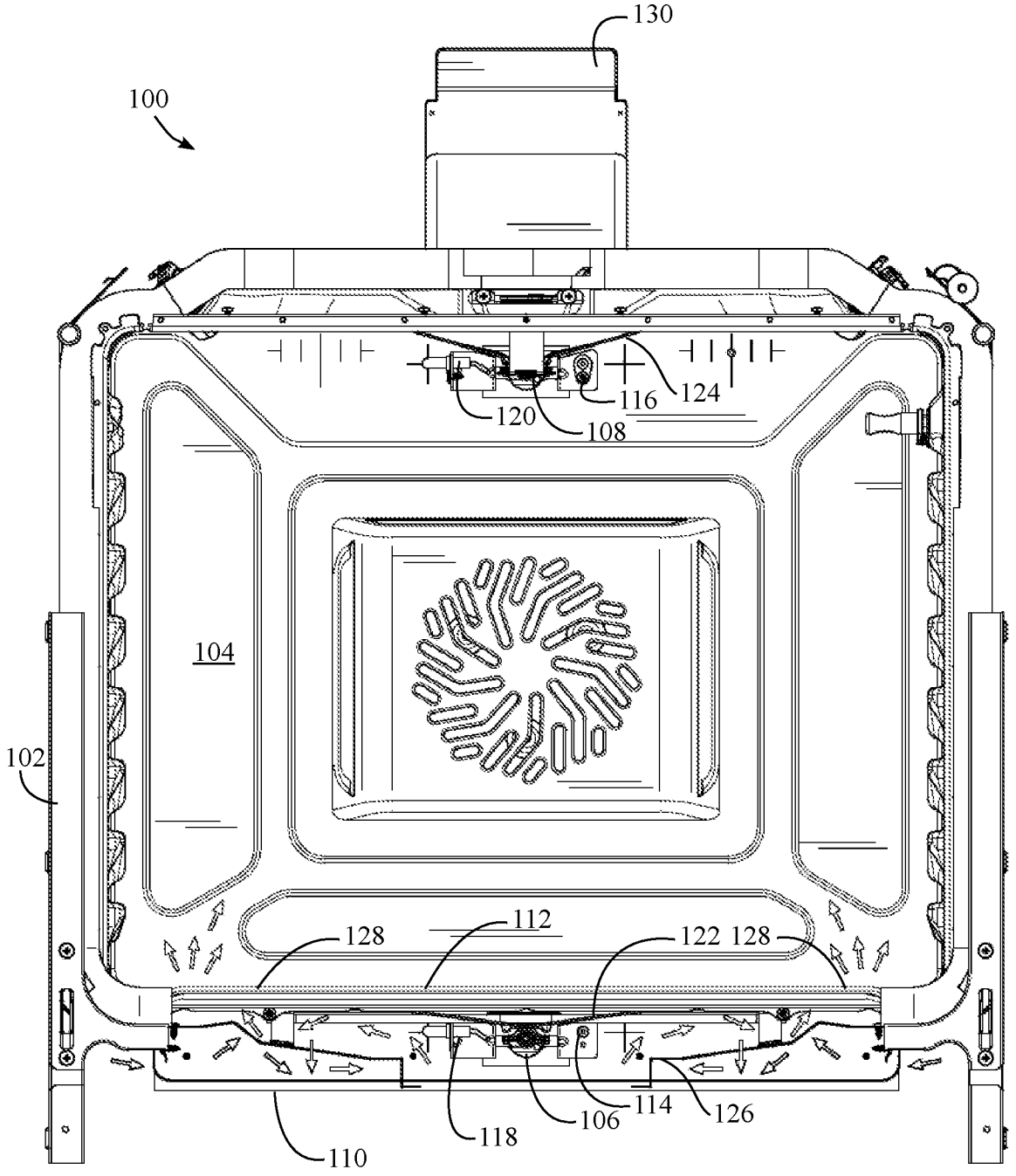
FIG. 4 is a front elevational view of the example cooking appliance oven cavity of FIG. 3, and including arrows representing flow paths in the oven cavity prior to establishing a steady state flow pattern in the oven cavity.
Figure 5:
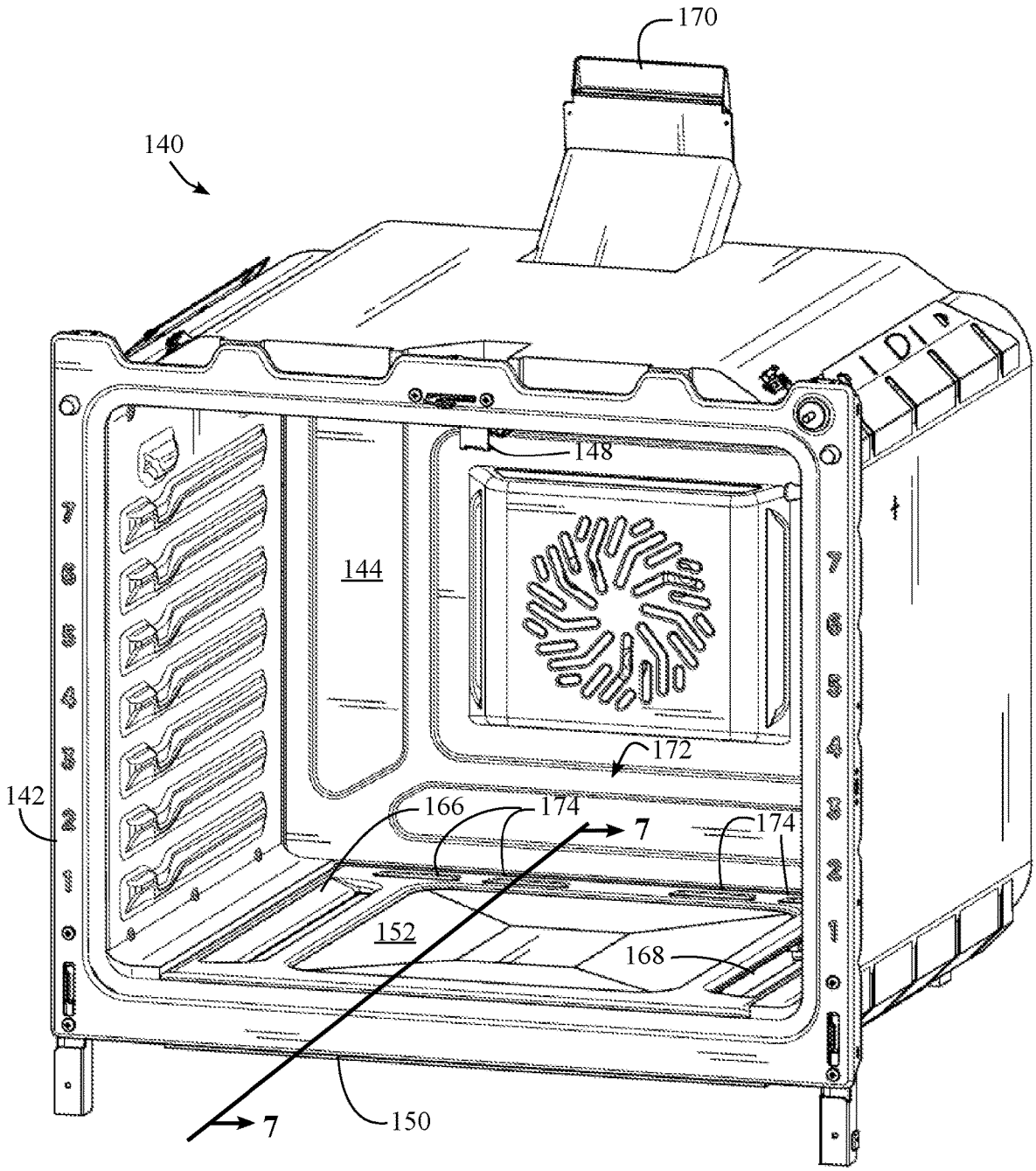
FIG. 5 is a perspective view of a cooking appliance oven cavity consistent with some embodiments of the invention.
Figure 6:
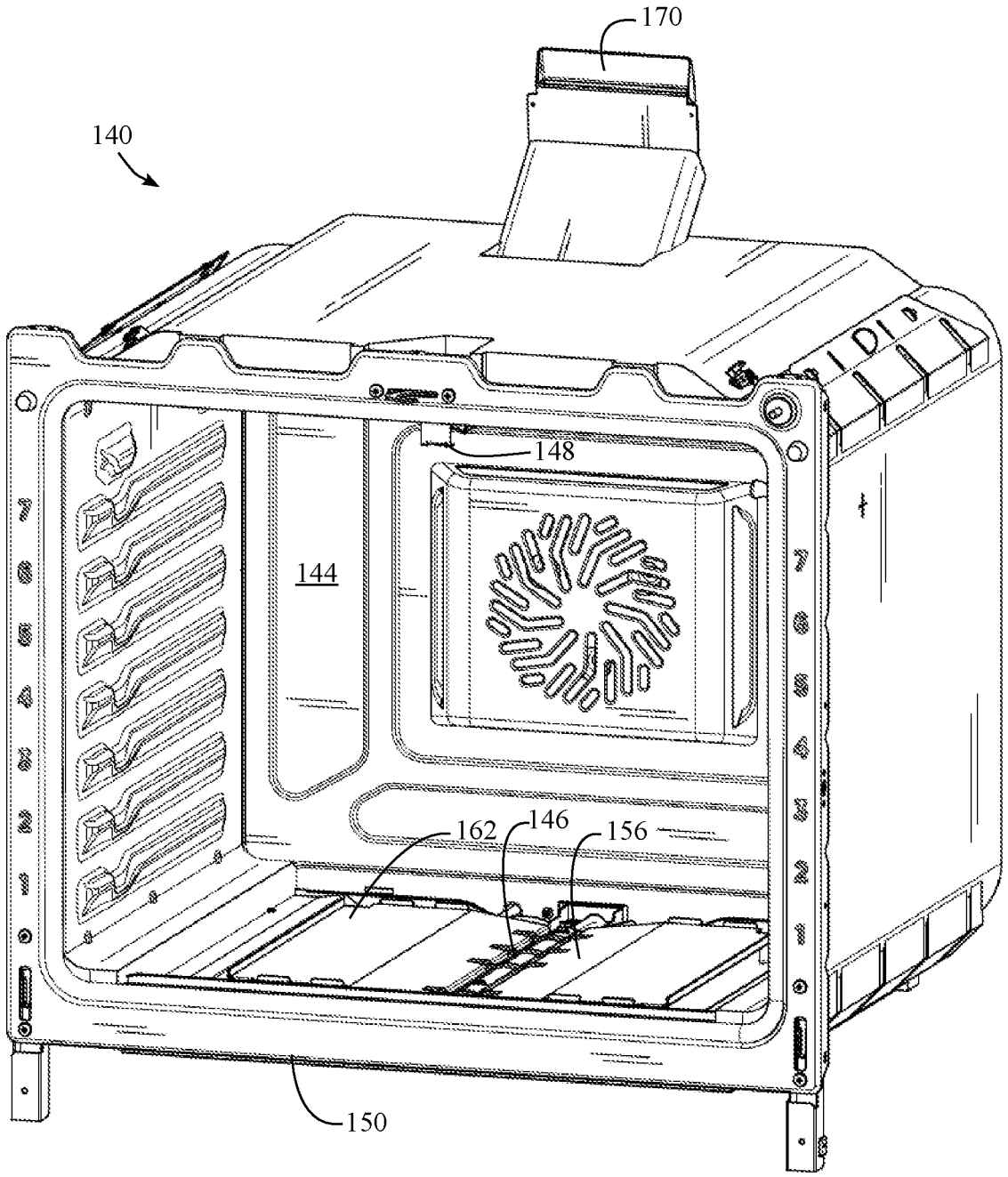
FIG. 6 is a perspective view of the cooking appliance oven cavity of FIG. 5, with the oven cavity bottom removed.
Figure 7:
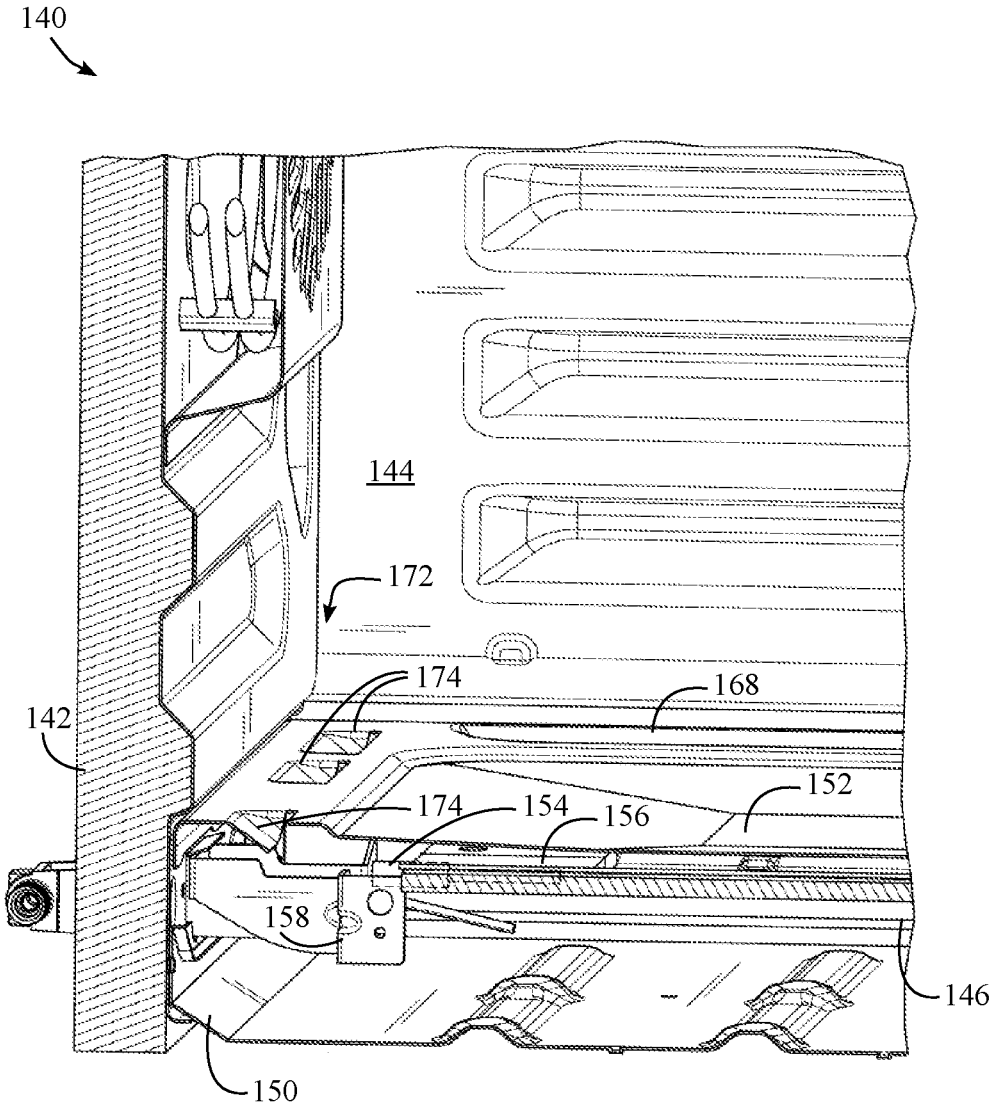
FIG. 7 is a cross-sectional view of the cooking appliance oven cavity of FIG. 5, taken along lines 7-7 thereof.

As illustrated by the arrows in FIG. 4, however, upon startup and during the warm-up phase of the cooking appliance, this gas movement is less controlled, slower, and may even run counter to the steady state flow pattern that is established after the warmup period. As a result, combustion is less than optimal, as are the quality and stability of the flames established at bake oven gas burner 106. This is partially due to an inefficient influx of fresh air available to the flames and an inefficient evacuation of combustion products from burner box 110, and in some instances, this inefficient flow is exacerbated by the presence of the flow divider 126 and the relatively long and tortuous path the combustion products must take from the bake oven gas burner 106 (which is generally centrally located) to the vents 128 (which are generally positioned proximate the side walls of the oven cavity. Furthermore, due to the instability of the flame due to the sub-optimal combustion, flame detector 114 may receive a signal during this warmup period that is intermittent and/or inconclusive due to poor contact with a less than optimal flame or flames.

Embodiments consistent with the invention, however, may incorporate a secondary venting arrangement that provides an alternate flow path to that of the primary venting arrangement that short-cuts the flow temporarily until the steady state flow paths are established, thereby providing stronger flames in the area of the flame detector with improved air supply and improved venting. The secondary venting arrangement in particular may be disposed in a lower portion of an oven cavity and adjacent to the flame detector, and may be configured to stabilize the flame detected by the flame detector prior to establishment of the steady state flow pattern in the oven cavity through localized venting of combustion products generated by the gas burner into the oven cavity adjacent the flame detector.

Localized venting, in this regard, refers to venting that is in the immediate vicinity of the flame detector, and in some embodiments, venting that is unobstructed by a flow divider or other intermediate structure, such that a direct flow path is created from the volume surrounding the flame detector and one or more vents comprising the secondary venting arrangement. Furthermore, to the extent that any flow divider is utilized in a burner box housing a gas burner, localized venting effectively bypasses that flow divider to reduce combustion product buildup in the volume adjacent to and surrounding the flame detector.

FIGS. 5-8, for example, illustrate an example cooking appliance 140 including a housing or structure 142 defining an oven cavity 144. Bake and broil gas oven burners 146, 148 are disposed proximate the bottom and top of the oven cavity 144, respectively. Broil gas oven burner 148 is disposed within the oven cavity 144, e.g., under the top wall thereof, while bake gas oven burner 146 (FIGS. 6 and 7) is disposed under the oven cavity 144, e.g., within a burner box 150 that is separated from the oven cavity 144 by an oven bottom 152, which may be configured as a removable bottom panel in some embodiments.

Each gas oven burner 146, 148 includes an associated flame detector positioned adjacent to the gas oven burner (e.g., flame detector 154 for bake gas oven burner 146, here implemented as a flame sense rod) and flame spreader (e.g., flame spreader 156 for bake gas oven burner 146). Further, in the illustrated embodiment, each gas oven burner 146, 148 includes an igniter (e.g., igniter 158 for bake gas oven burner 146) configured to ignite gas supplied to the gas oven burner and a gas valve configured to supply gas from a gas supply to the gas oven burner. While igniter 158 is illustrated as being on the opposite side of bake gas oven burner 146 as flame detector 154, it will be appreciated that in other embodiments, these components may be disposed at other locations, e.g., at opposite ends, at the same end and side, etc.

It will be appreciated that in this embodiment, bake gas oven burner 146 extends from a first end proximate a rear of the oven cavity 144 towards a second end proximate a front of oven cavity 144, and is in fluid communication with the gas supply through a gas valve (not shown in FIG. 7) proximate its first end. Furthermore, flame detector 154 is disposed proximate the first end of the bake gas oven burner 146, and flame spreader 156 extends generally laterally (i.e., side-to-side) from bake gas oven burner 146. Other burner configurations, e.g., U-shaped or side-to-side, may be used in other embodiments.

Fresh air in cooking appliance 140 is generally supplied from the left and right sides of the appliance, e.g., through fresh air inlets formed in the sides of burner box 150. In other embodiments, fresh air may be supplied from fresh air inlets formed in the center, front and/or back of the burner box, so the invention is not limited to fresh air inlets disposed on the side of the burner box. Flow divider 162 (FIG. 6) extends underneath oven cavity 144 and laterally across each side of bake gas oven burner 146 such that fresh air entering the sides of burner box 150 passes along the underside of the flow divider and to the bake gas oven burner 146 for combustion. Combustion products generated by the bake gas oven burner 146 then pass along the topside of flow divider 162 and underneath flame spreader 156 and oven bottom 152.

A primary venting arrangement disposed in a lower portion of oven cavity 144, here including a pair of primary vents 166, 168, is configured to vent combustion products and excess air into oven cavity 144 and out an exhaust vent 170 as a result of a steady state flow pattern established in oven cavity 144 after oven cavity 144 has been warmed by heat generated by the bake gas oven burner 146. At least some of the combustion products and any excess air is thus carried across the topside of flow divider 162 and underneath flame spreader 156, through vents 166, 168 and into oven cavity 144, and then out of oven cavity 144 and through exhaust vent 170.

In this embodiment, a secondary venting arrangement 172, incorporating a plurality (e.g., four) vents 174, is disposed in the lower portion of oven cavity 144 and adjacent to the flame detector. Secondary venting arrangement 172 is configured to stabilize the flame detected by flame detector 154 prior to establishment of the steady state flow pattern in oven cavity 144 through localized venting of combustion products generated by bake gas oven burner 146 into oven cavity 144 adjacent flame detector 154. In addition, for at least one or more of vents 174, the secondary venting arrangement 172 effectively bypasses flow divider 162 for at least a portion of the combustion products and excess air to reduce the amount of combustion products building in the volume adjacent flame detector 154, whereby at least a portion of the combustion products generated by bake gas oven burner 146 flow from the bake gas oven burner to secondary venting arrangement 172 without flowing over the topside of flow divider 162 (and underneath flame spreader 156) to primary vents 166, 168. Further, as it may be seen from FIG. 7, vents 174 are positioned rearwardly of one or both of a rearward edge of flame spreader 156 and a rearward edge of flow divider 162 (vents 174 are positioned rearwardly of the rearward edge of flame spreader 156 but not rearwardly of the rearward edge of flow divider 162 in FIG. 7), thereby providing a relatively straight and unobstructed flow path from the volume adjacent the flame detector 154 to vents 174. It should be noted that this path is also shorter in length than the paths to primary vents 166, 168. In addition, at least one of vents 174 may be directly above flame detector 154 in some embodiments.

Thus, during startup and prior to establishing a steady state flow pattern, at least a portion of the combustion products and excess air in the vicinity surrounding flame detector 154 will flow through vents 174 of secondary venting arrangement 172 rather than primary vents 166, 168, thereby establishing stronger flames in the area of the flame detector with improved air supply and improved venting. A portion of the combustion products and excess air may still be vented through primary vents 166, 168 during this time, and it will further be appreciated that once the thermal gradient and steady state flow pattern have been established, combustion products and excess air may still be vented through both the primary and secondary venting arrangements.

It will be appreciated that while four individual vents 174 are illustrated for secondary venting arrangement 172, and the primary venting arrangement is implemented using two primary vents 166, 168 running proximate the left and right sides of oven cavity 144 in FIGS. 5-8, different numbers and/or locations of vents may be used for either venting arrangement in other embodiments, e.g., more vents, or as few as one vent for each of the primary and secondary venting arrangements.

In addition, while vents 174 of secondary venting arrangement 172 are illustrated as being disposed in a removable bottom panel forming oven bottom 152 in FIGS. 5-8, in other embodiments, a secondary venting arrangement may include vents disposed in other structures proximate the bottom of an oven cavity. FIG. 9, for example, illustrates an example cooking appliance 200 in which a structure or housing 202 includes a removable bottom panel 204 that is supported by a fixed cavity portion 206. While primary vents 208, 210 are still disposed on the removable bottom panel 204, a secondary venting arrangement 212, including vents 214, is disposed in the fixed portion 206.

Figure 10:
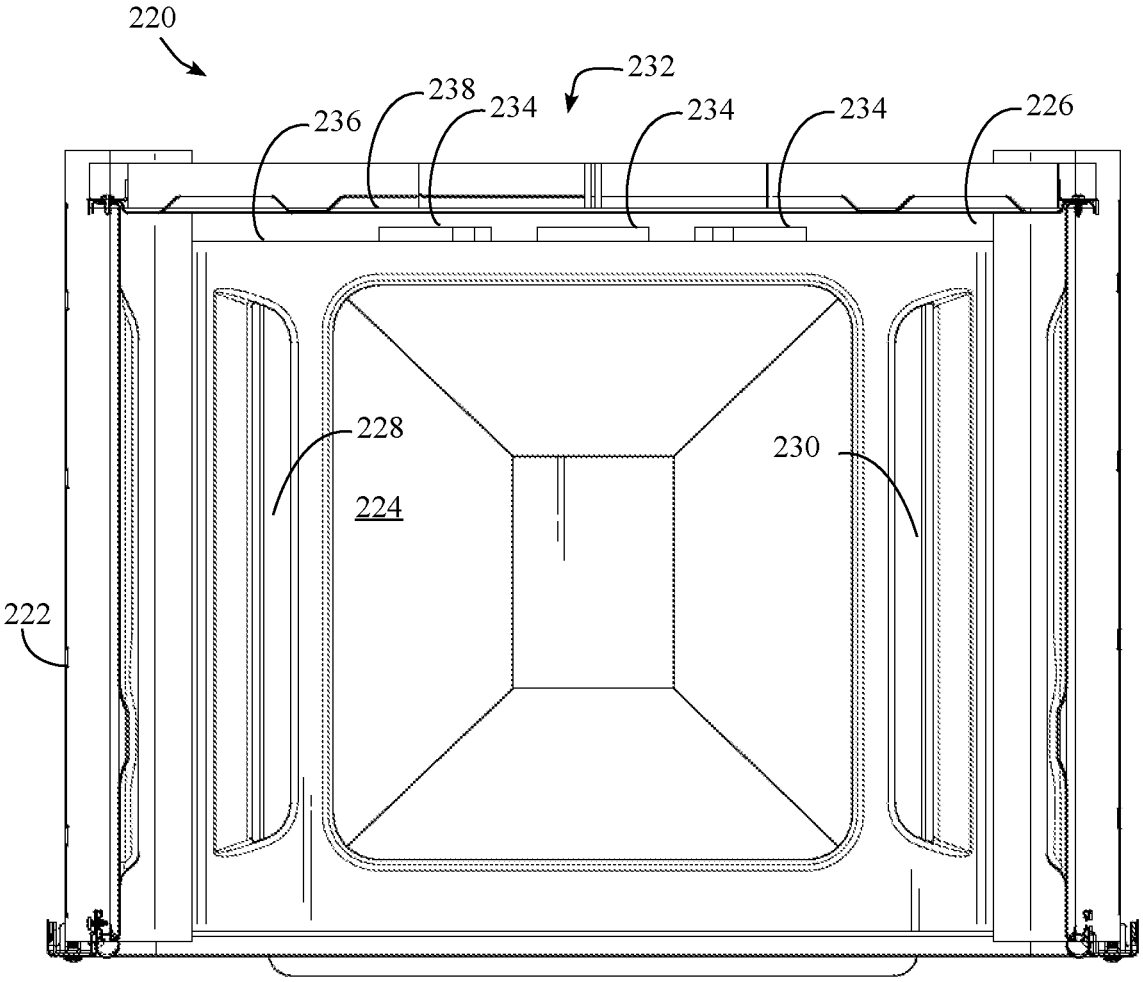
FIG. 10 is a top plan view of the bottom of yet another cooking appliance oven cavity, and illustrating yet another example implementation of a secondary venting arrangement consistent with the invention.

As another example, FIG. 10 illustrates an example cooking appliance 220 in which a structure or housing 222 includes a bottom panel 224 that is supported by a flange 226. While primary vents 228, 230 are still disposed on the removable bottom panel 224, a secondary venting arrangement 232, including vents 234, is formed from reliefs in flange 226. A rear edge 236 of bottom panel 224 is separated from a rear wall 238 of the oven cavity to expose flange 226, such that the reliefs form vents 234 of secondary venting arrangement 232.

Figure 8:
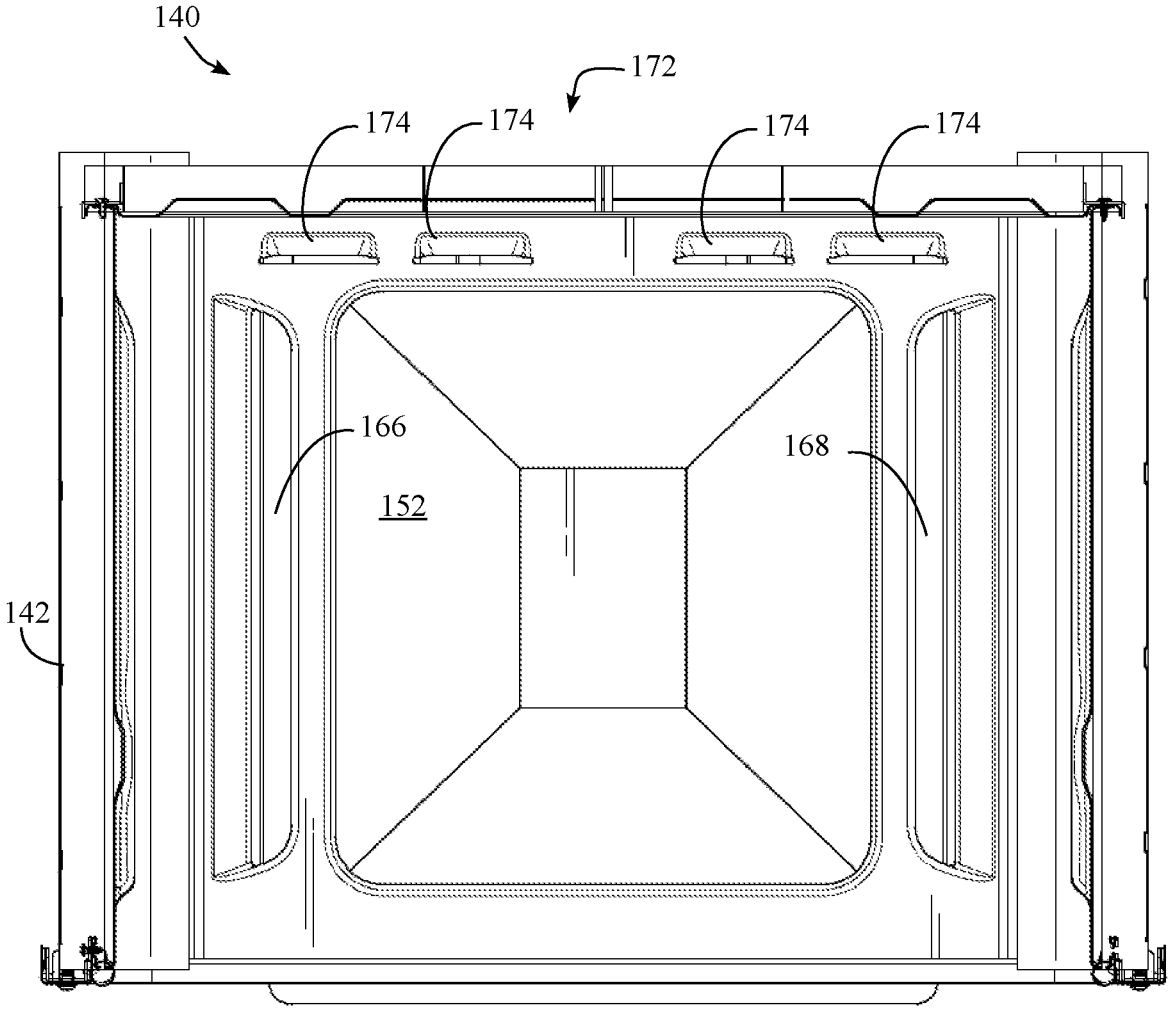
FIG. 8 is a top plan view of the bottom of the cooking appliance oven cavity of FIG. 5, and illustrating an example implementation of a secondary venting arrangement consistent with the invention.
Figure 9:
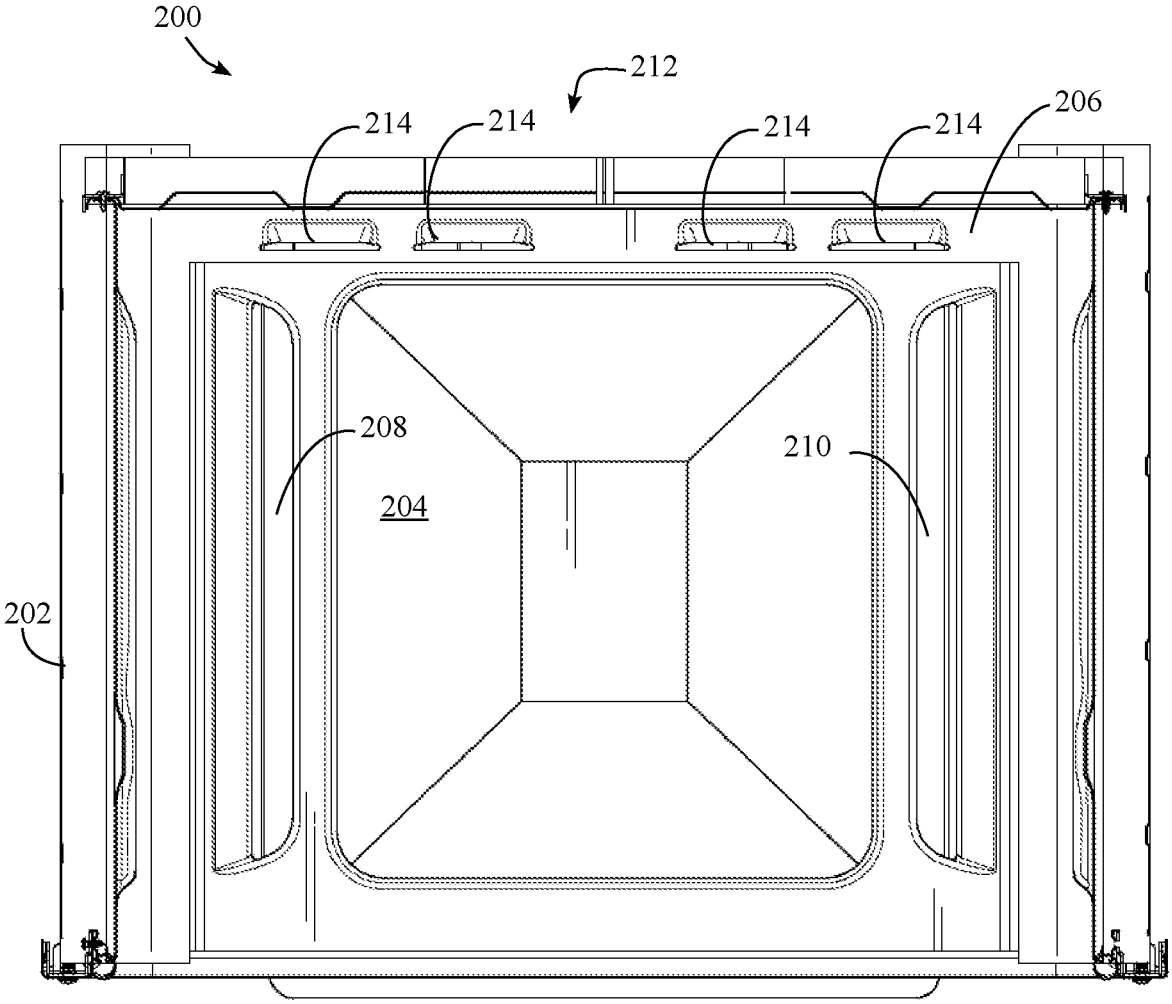
FIG. 9 is a top plan view of the bottom of another cooking appliance oven cavity, and illustrating another example implementation of a secondary venting arrangement consistent with the invention.

Other vent locations, including combinations of vents disposed in the various locations illustrated in FIGS. 8-10, may be used in other embodiments, as will be appreciated by those of ordinary skill having the benefit of the instant disclosure.

It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A cooking appliance, comprising:

a housing including an oven cavity;

an exhaust vent disposed proximate a top of the oven cavity;

a gas burner disposed under the oven cavity;

a flame detector disposed adjacent to the gas burner and configured to detect a flame emitted by the gas burner;

one or more fresh air inlets disposed underneath the oven cavity and configured to supply fresh air to the gas burner;

a primary venting arrangement disposed in a lower portion of the oven cavity, the primary venting arrangement configured to vent combustion products generated by the gas burner into the oven cavity and out the exhaust vent as a result of a steady state flow pattern established in the oven cavity after the oven cavity has been warmed by heat generated by the gas burner;

a flow divider disposed underneath the oven cavity and configured to separate the fresh air supplied by the one or more fresh air inlets from the combustion products vented through the primary venting arrangement; and a secondary venting arrangement disposed in the lower portion of the oven cavity and adjacent to the flame detector, the secondary venting arrangement configured to stabilize the flame detected by the flame detector prior to establishment of the steady state flow pattern in the oven cavity through localized venting of combustion products generated by the gas burner into the oven cavity adjacent the flame detector;

wherein the secondary venting arrangement provides a shorter flow path around the flow divider than a flow path provided by the primary venting arrangement to reduce combustion product buildup in a volume adjacent the flame detector.

2. The cooking appliance of claim 1, wherein the gas burner extends from a first end proximate a rear of the oven cavity towards a second end proximate a front of the oven cavity, and wherein the flame detector is disposed proximate the first end of the gas burner.

3. The cooking appliance of claim 2, wherein the gas burner is in fluid communication with a gas supply proximate the first end of the gas burner.

4. The cooking appliance of claim 2, wherein the one or more fresh air inlets includes first and second air inlets disposed underneath the oven cavity and respectively proximate first and second sides of the oven cavity, wherein the primary venting arrangement includes first and second primary vents formed in a bottom panel of the oven cavity and respectively disposed proximate the first and second sides of the oven cavity, wherein the flow divider extends along first and second sides of the gas burner, wherein fresh air flows inwardly towards the gas burner from the first and second air inlets on an underside of the flow divider, wherein at least a portion of the combustion products generated by the gas burner when the steady state flow pattern is established flow outwardly from the gas burner to the first and second primary vents on the topside of the flow divider, and wherein the secondary venting arrangement is positioned relative to the gas burner and the flame detector such that at least a portion of the combustion products generated by the gas burner flow from the gas burner to the secondary venting arrangement without flowing over the topside of the flow divider.

5. The cooking appliance of claim 4, wherein the secondary venting arrangement includes one or more vents positioned rearwardly of a rear edge of the flow divider.

6. The cooking appliance of claim 4, further comprising a flame spreader positioned above the gas burner and extending towards the first and second sides of the oven cavity, wherein the secondary venting arrangement includes one or more vents positioned rearwardly of a rear edge of the flame spreader.

7. The cooking appliance of claim 1, wherein the secondary venting arrangement includes one or more vents formed proximate a bottom of the oven cavity.

8. The cooking appliance of claim 7, wherein the oven cavity includes a bottom panel, and wherein the one or more vents are formed in the bottom panel.

9. The cooking appliance of claim 8, wherein the bottom panel is removable from the oven cavity.

10. The cooking appliance of claim 7, wherein the oven cavity includes a bottom panel supported on a flange circumscribing a bottom of the oven cavity, and wherein the one or more vents are formed in part by one or more reliefs in the flange.

11. The cooking appliance of claim 7, wherein the oven cavity includes a removable bottom panel supported by a fixed cavity portion, and wherein the one or more vents are formed in the fixed cavity portion.

12. The cooking appliance of claim 7, wherein the one or more vents includes first and second vents respectively disposed proximate first and second sides of the gas burner.

13. The cooking appliance of claim 7, wherein the one or more vents includes a first vent disposed directly above the flame detector.

14. The cooking appliance of claim 1, wherein the flame detector includes a flame sense rod.

15. A cooking appliance, comprising:

a housing including an oven cavity;

an exhaust vent disposed proximate a top of the oven cavity;

a gas burner disposed under the oven cavity;

a flame detector disposed adjacent to the gas burner and configured to detect a flame emitted by the gas burner;

a primary venting arrangement disposed in a lower portion of the oven cavity, the primary venting arrangement configured to vent combustion products generated by the gas burner into the oven cavity and out the exhaust vent as a result of a steady state flow pattern established in the oven cavity after the oven cavity has been warmed by heat generated by the gas burner; and a secondary venting arrangement disposed in the lower portion of the oven cavity and adjacent to the flame detector, the secondary venting arrangement configured to stabilize the flame detected by the flame detector prior to establishment of the steady state flow pattern in the oven cavity through localized venting of combustion products generated by the gas burner into the oven cavity adjacent the flame detector;

wherein the secondary venting arrangement includes one or more vents formed proximate a bottom of the oven cavity, and wherein the one or more vents includes first and second vents respectively disposed proximate first and second sides of the gas burner.

16. The cooking appliance of claim 15, wherein the oven cavity includes a bottom panel, and wherein the first and second vents are formed in the bottom panel.

17. The cooking appliance of claim 16, wherein the bottom panel is removable from the oven cavity.

18. The cooking appliance of claim 15, wherein the oven cavity includes a bottom panel supported on a flange circumscribing a bottom of the oven cavity, and wherein the first and second vents are formed in part by first and second reliefs in the flange.

19. The cooking appliance of claim 15, wherein the oven cavity includes a removable bottom panel supported by a fixed cavity portion, and wherein the first and second vents are formed in the fixed cavity portion.

20. A cooking appliance, comprising:

a housing including an oven cavity;

an exhaust vent disposed proximate a top of the oven cavity;

a gas burner disposed under the oven cavity;

a flame detector disposed adjacent to the gas burner and configured to detect a flame emitted by the gas burner, wherein the flame detector includes a flame sense rod;

a primary venting arrangement disposed in a lower portion of the oven cavity, the primary venting arrangement configured to vent combustion products generated by the gas burner into the oven cavity and out the exhaust vent as a result of a steady state flow pattern established in the oven cavity after the oven cavity has been warmed by heat generated by the gas burner; and a secondary venting arrangement disposed in the lower portion of the oven cavity and adjacent to the flame detector, the secondary venting arrangement configured to stabilize the flame detected by the flame detector prior to establishment of the steady state flow pattern in the oven cavity through localized venting of combustion products generated by the gas burner into the oven cavity adjacent the flame detector.

* * * * *